US007354334B1

(12) United States Patent
Birang et al.

(10) Patent No.: US 7,354,334 B1
(45) Date of Patent: Apr. 8, 2008

(54) REDUCING POLISHING PAD DEFORMATION

(75) Inventors: Manoocher Birang, Los Gatos, CA (US); Boguslaw A. Swedek, Cupertino, CA (US); Doyle E. Bennett, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 47 days.

(21) Appl. No.: 11/124,420

(22) Filed: May 6, 2005

Related U.S. Application Data

(60) Provisional application No. 60/569,467, filed on May 7, 2004.

(51) Int. Cl.
*B24B 1/00* (2006.01)

(52) U.S. Cl. ..... 451/6; 451/287; 451/526

(58) Field of Classification Search ..... 451/6, 451/9, 10, 11, 41, 285, 287, 290, 526, 530, 451/533
See application file for complete search history.

(56) References Cited

U.S. PATENT DOCUMENTS 5,893,796 A * 4/1999 Birang et al. ..... 451/526
5,913,713 A 6/1999 Cheek et al.
6,068,539 A 5/2000 Bajaj et al.
6,071,178 A 6/2000 Baker, III
6,217,426 B1 4/2001 Tolles et al.
6,220,942 B1 * 4/2001 Tolles et al. ..... 451/65
6,244,935 B1 6/2001 Birang et al.
6,280,290 B1 * 8/2001 Birang et al. ..... 451/6
6,575,825 B2 6/2003 Tolles et al.
6,599,765 B1 7/2003 Boyd et al.
6,620,036 B2 9/2003 Freeman et al.
6,696,005 B2 * 2/2004 Strasbaugh ..... 264/263
6,699,104 B1 * 3/2004 Baker et al. ..... 451/28
6,855,034 B2 * 2/2005 Hasegawa ..... 451/41
2002/0068516 A1 * 6/2002 Chen et al. ..... 451/285
2002/0077031 A1 * 6/2002 Johansson et al. ..... 451/6
2002/0115379 A1 * 8/2002 Sevilla et al. ..... 451/6
2002/0144372 A1 * 10/2002 Piombini ..... 15/230.1
2002/0173231 A1 11/2002 Hasegawa
2003/0148721 A1 8/2003 Birang et al.
2003/0181135 A1 9/2003 Liu
2003/0236055 A1 12/2003 Swedek et al.
2004/0018809 A1 * 1/2004 Petroski et al. ..... 451/537

OTHER PUBLICATIONS

U.S. Appl. No. 11/213,623, filed Aug. 26, 2005.

* cited by examiner

*Primary Examiner*—Eileen P. Morgan
(74) *Attorney, Agent, or Firm*—Fish & Richardson

(57) ABSTRACT

A polishing system can have a polishing pad with a polishing surface and a bottom surface that includes a recess with a thickness less than the thickness of the polishing pad. An in-situ monitoring module can be positioned in a cavity formed in part by the recess. A vent path is provided with an opening to the cavity.

20 Claims, 9 Drawing Sheets

REDUCING POLISHING PAD DEFORMATION

CROSS-REFERENCE TO RELATED APPLICATIONS

This application claims the benefit of priority under 35 U.S.C. §119(e)(1) to U.S. Provisional Application Ser. No. 60/569,467, filed May 7, 2004. The disclosure of the prior application is considered part of and is incorporated by reference in the disclosure of this application.

BACKGROUND

This present invention relates to chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

SUMMARY

The invention provides methods and apparatus for reducing polishing pad deformation.

In one aspect, the invention is directed to a polishing pad for use in a chemical mechanical polishing system. The polishing pad includes a polishing surface and a non-polishing surface opposed to the polishing surface, and has a thickness. The polishing pad includes a recess on the non-polishing surface. The recess has a depth less than the thickness of the polishing pad and has no opening to the polishing surface. The polishing pad includes a vent path. The vent path has a first opening to the recess and a second opening to a surface other than the polishing surface.

Implementations of the polishing pad may include one or more of the following features. The polishing pad may include a side edge surface and the second opening may be in the side edge surface. The vent path may be curved and the second opening may be located at a radial offset from the first opening. The second opening may be wider than the first opening. The vent path may be notched to form the wider second opening. A width of the vent path may gradually increase to form the wider second opening. The polishing pad may include an outer layer and a backing layer. The vent path may be a groove formed in the backing layer. The groove may have the same thickness as the backing layer. The vent path may be a groove formed in the outer layer. The vent path may be a groove formed on the non-polishing surface. The vent path may be a passage formed in the polishing pad.

In another aspect, the invention is directed to a polishing system that includes a polishing pad that includes a polishing surface, a non-polishing opposed to the polishing surface, and a first recess in the non-polishing surface. The first recess has a depth less than the thickness of the polishing pad and has no opening to the polishing surface. The system includes a platen that supports the polishing pad at a surface that is configured to receive the polishing pad. The platen includes a second recess; the second recess being configured to receive an in situ monitoring module. The system includes a cavity formed at least in part by the first recess and one of: i) a window of the monitoring module; or ii) the platen. The system includes a vent path. The vent path has a first opening in the cavity and a second opening not in the cavity.

Implementations of the system may include one or more of the following features. The platen may includes a side edge surface and the vent path has a second opening in the side edge surface. The vent path may be curved and the second opening may be located at a radial offset from the first opening. The vent path may slope so as to drain fluid from the cavity. The second opening may be wider than the first opening. The vent path may be notched to form the wider second opening. A width of the vent path may gradually increase to form the wider second opening. The vent path may be a groove formed partly in the polishing pad and partly in the platen. The vent path may be a groove formed on the surface of the platen and on the non-polishing surface of the polishing pad. The vent path may be a groove formed on the surface of the platen.

In another aspect, the invention is directed to a platen for use in a chemical mechanical polishing system. The platen includes a surface configured to receive a polishing pad and a side edge. The platen includes a recess formed on the surface, the recess being configured to receive an in-situ monitoring module. The platen includes a vent path with a first opening to the recess and a second opening to the side edge.

Implementations of the system may include one or more of the following features. The vent path may be a groove in the surface of the polishing pad. The vent path may be a passage through the polishing pad.

The invention can provide one or more of the following advantages. Deformation of the polishing pad, particularly in the area of the thin portion of the polishing pad, can be reduced or eliminated. Uneven polishing can thus be reduced. The vent path can be configured to prevent capillary action from suctioning slurry into the recess. The vent path can be configured to use gravity to drain fluid from the recess. One implementation can provide all of the above described advantages.

The details of one or more embodiments of the invention are set forth in the accompanying drawings and the description below. Other features, objects, and advantages of the invention will be apparent from the description and drawings.

DESCRIPTION OF DRAWINGS

Like reference symbols in the various drawings indicate like elements.

DETAILED DESCRIPTION

Figure 1A:
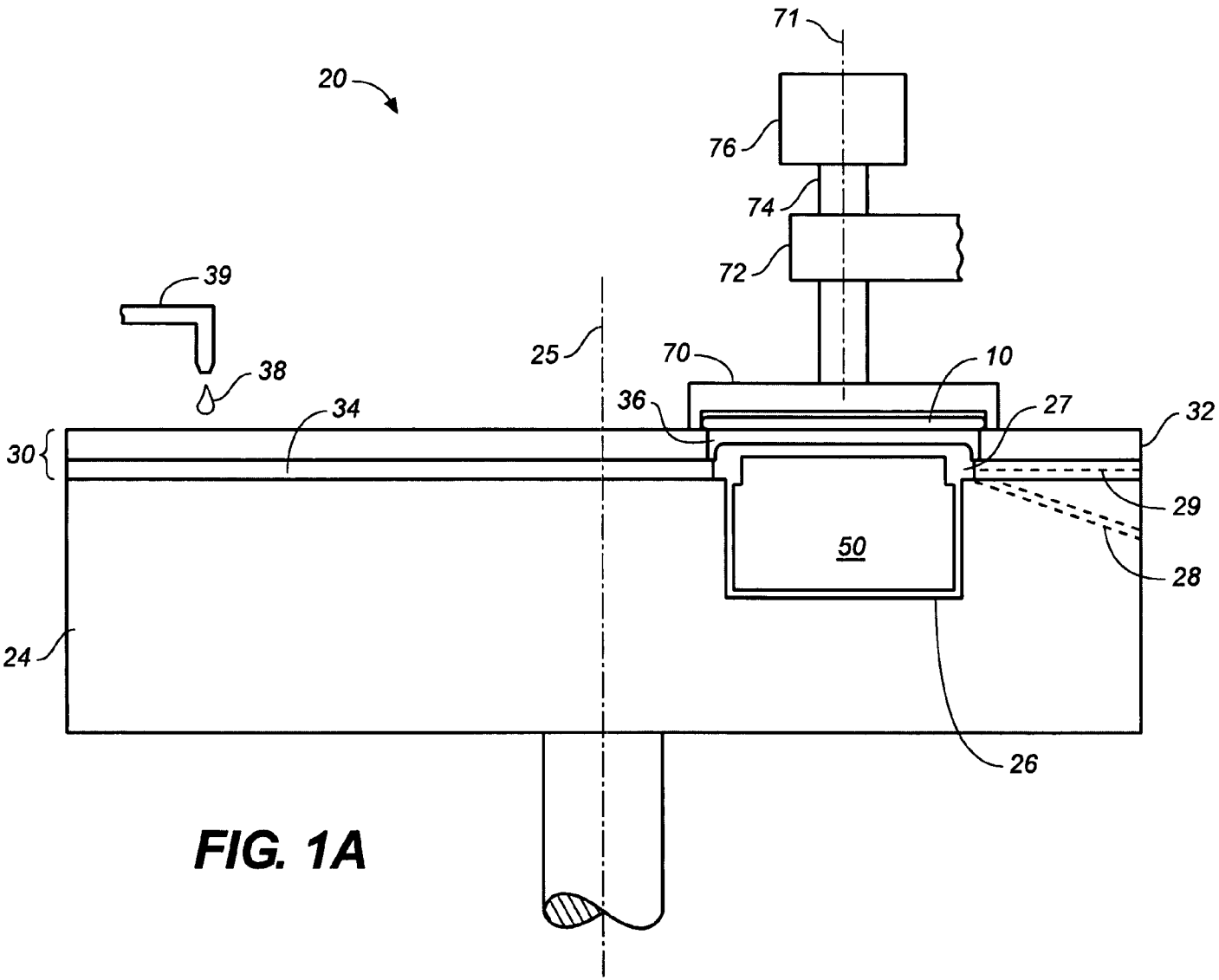
FIG. 1A is a schematic side view, partially cross-sectional, of a chemical mechanical polishing station configured to reduce deformation of the polishing pad.

As shown in FIG. 1A, one or more substrates 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable disk-shaped platen 24 on which is placed a polishing pad 30. The polishing pad 30 can be secured to the platen 24, e.g., by a layer of adhesive. The polishing pad 30 can be a two-layer polishing pad with an outer polishing layer 32 and a softer backing layer 34. The polishing station can also include a pad conditioner apparatus to maintain the condition of the polishing pad so that it will effectively polish substrates.

During a polishing step, a slurry 38 containing a liquid and a pH adjuster can be supplied to the surface of polishing pad 30 by a slurry supply port or combined slurry/rinse arm 39. Slurry 38 can also include abrasive particles.

A carrier head 70 can hold the substrate 10 against the polishing pad 30. The carrier head 70 is suspended ended from a support structure 72, for example, a carousel, and is connected by a carrier drive shaft 74 to a carrier head rotation motor 76 so that the carrier head can rotate about an axis 71. In addition, the carrier head 70 can oscillate laterally in a radial slot formed the support structure 72. In operation, the platen is rotated about its central axis 25, and the carrier head is rotated about its central axis 71 and translated laterally across the top surface of the polishing pad. A description of a suitable carrier head 70 can be found in U.S. Pat. Nos. 6,422,927 and 6,450,868, and U.S. Patent Publication No. 2005/0211377, the entire disclosures of which are incorporated by reference.

A recess 26 is formed in platen 24, and an in-situ monitoring module 50 of an in situ monitoring system fits into the recess 26. The in-situ monitoring system can be an eddy current monitoring system, an optical monitoring system or another type of monitoring system or a combination of multiple monitoring systems. The in-situ monitoring module 50 can include one or more sensor elements, which provide better resolution when they are situated close to the substrate being polished. Examples of a sensor element include but are not limited to a U-shaped ferromagnetic core, an E-shaped ferromagnetic core, and a light source and detector. A suitable in-situ module is further described in commonly owned U.S. Pat. No. 7,001,242, and in U.S. Patent Publication Nos. 2005/0024047 and 2003/0148721, which are hereby incorporated by reference in their entireties.

The polishing pad can include a region 36 that is thinner than other portions of the polishing pad. In particular, the region 36 can be a portion of the polishing pad which is thinner than the polishing layer, e.g., less than 50% of the thickness of the polishing layer. The region 36 can be an integral portion of the polishing pad, or it can be an element secured, e.g., molded or adhesively attached, to the polishing pad.

For example, the region can be a recess is formed in the bottom surface of the polishing pad or the element secured in the polishing pad. This recess extends partially but not entirely through the polishing layer, so that a thin section of the polishing layer or element remains.

The region 36 is situated over at least a portion of the recess 26 and the module 50. The module 50 and region 36 are positioned such that they pass beneath substrate 10 during a portion of the platen's rotation. The region 36 can be transparent or opaque and, furthermore, can have a top surface that lies flush with the top surface of the polishing pad 30. The region 36 does not provide an opening for fluid to flow between the recess 26 and the top surface of the polishing pad 30.

In one implementation, the region 36 is part of a plug that includes one or more recesses or indentations configured to accommodate a top portion of the module 50. The recesses allow the sensor of the module 50 to be situated at a distance from the substrate that is less than the thickness of the polishing pad 30. The plug is secured, for example, by an adhesive applied between the interface of the plug and the backing layer 34, so that the side walls of the plug abuts the side walls of an aperture in the outer layer 32. The aperture is of the same shape as the plug so that the plug mates with the aperture. The adhesive can form a slurry-tight seal between the plug and the backing layer 34. The seal prevents slurry from leaking through the interface of the plug and the backing layer 34. Optionally, the seal can be air tight.

In general, the material of the plug should be non-magnetic and non-conductive. The plug can be a relatively pure polymer or polyurethane, for example, formed without fillers, or the plug can be formed of Teflon or a polycarbonate.

As a suitable alternative to using an adhesive, a molding process can be used to secure the plug and pad. In particular, the plug and pad can be secured together by molding the pad material around the plug. The pad material, when cured, bonds with and is, thus, secured to the plug.

In an alternative implementation, the region 36 can be a thinned section of the outer layer 32. The thinned section, like the recess in the plug, allows the sensor element of the module 50 to be situated at a distance from the substrate that is less than the thickness of the polishing pad 30. In this alternative implementation, the outer layer 32 is one contiguous piece and, as such, provides a barrier against slurry leakage into the platen 24.

In implementations where the region 36 provides a barrier against slurry leakage between the recess 26 and the top surface of the polishing pad 20, for example, the above described implementations, the region 36, together with the top portion of the module 50 and the side walls of the platen 24, can form a cavity 27, which can trap fluid and/or be air tight. Forces applied during polishing can cause the region 36 to deform and form a bump in the outer layer 32 of the polishing pad 30. However, such a deformation can be avoided or reduced by venting the cavity 27. Without being limited to any particular theory, it is believed that venting the cavity 27 permits any trapped fluid to escape from the cavity 27. Venting can be effected by one or more vent paths, for example, vent path 28 and vent path 29. In general, the vent path extends from the cavity 27 laterally to the edge of the polishing pad or platen. The vent path can include a channel that permits fluid flow, such as a passage formed within the body of a layer of the polishing pad, or a groove formed on a surface of or entirely through a layer of the polishing pad. In general, the vent path is shallower than the recess in the polishing pad. However, the vent path can still have significant depth, e.g., extend partially or entirely through the backing layer 34. If an adhesive layer is present on the bottom surface of the backing layer, a groove formed on the bottom surface of the polishing pad can extend through the adhesive and into the backing layer.

The vent path can have a round cross section. Alternatively, the vent path can have cross sections of other geometric shapes, for example, oval, square, rectangle, and triangle. The vent path can be straight or, alternatively, curved. The vent path can slope so that fluid will drain away from the cavity 27.

Figure 1B:
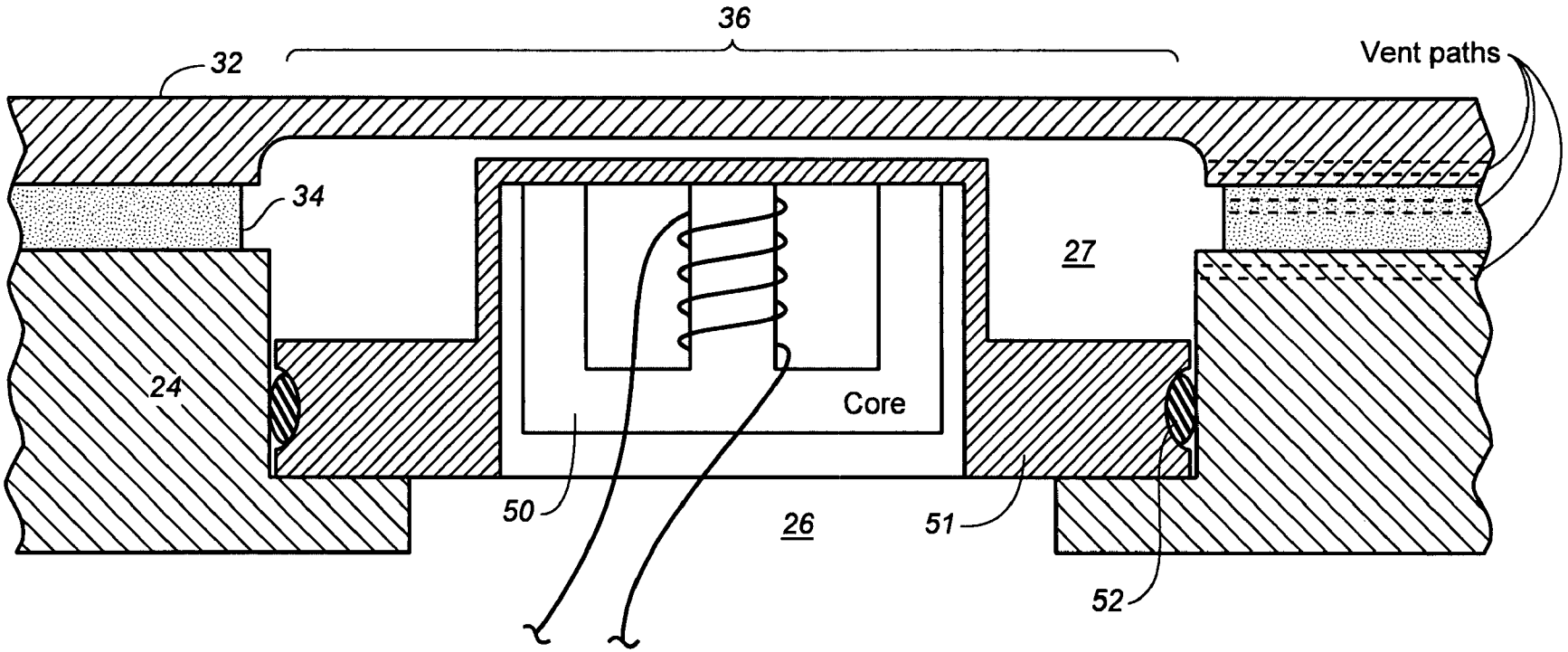
FIG. 1B is an enlarged view of a recess formed beneath the polishing pad.

FIG. 1B shows an enlarged view of the cavity 27 and the module 50. As can be seen, the housing 51 for the in-situ monitoring module 50, an O-ring 52, the side walls of the platen 24, the side walls of the backing layer 34, and the inner surface outer layer 32 collectively form the cavity 27. A vent path can be formed to vent and/or drain the cavity 27 through, for example, the platen 24, the outer layer 32, or the backing layer 34. Such a vent path can be formed without violating the slurry-tight integrity of the outer layer. Furthermore, the vent path can be formed without violating the integrity of the seal provided by the O-ring 52.

Figure 2A:
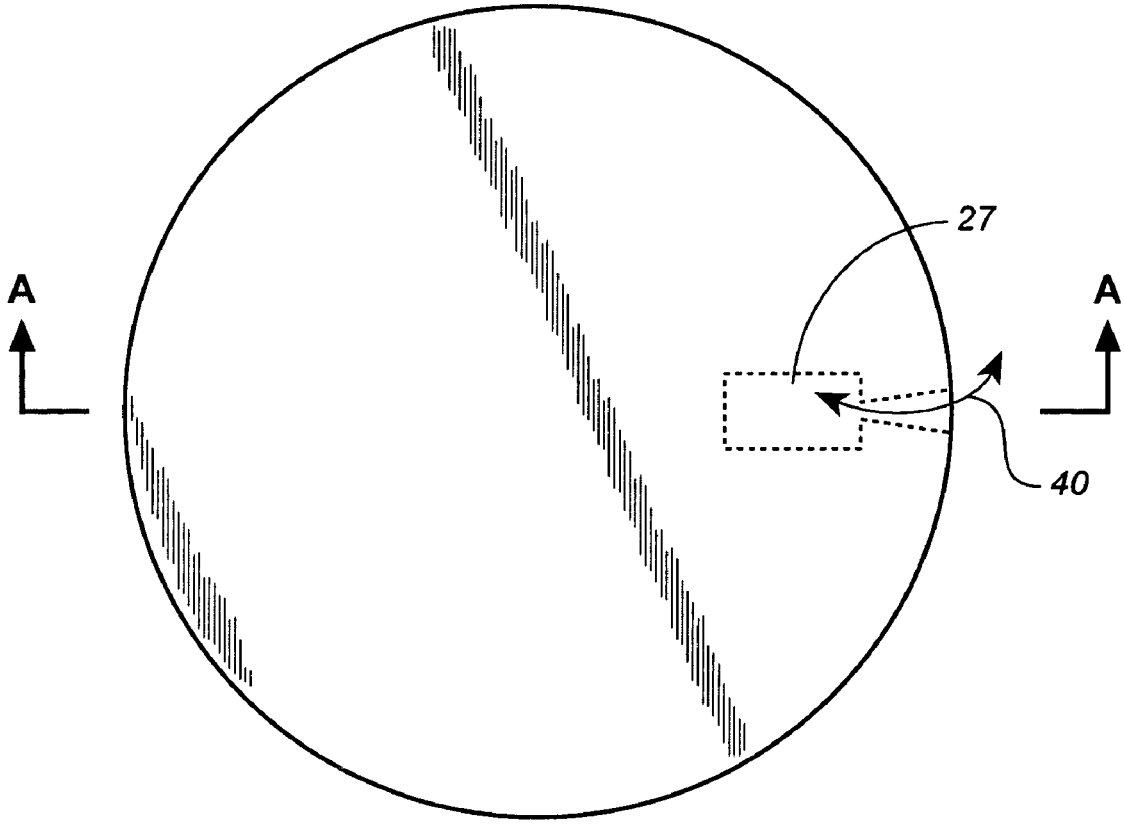
FIGS. 2A and 2B show a first implementation of a vent path.
Figure 2B:
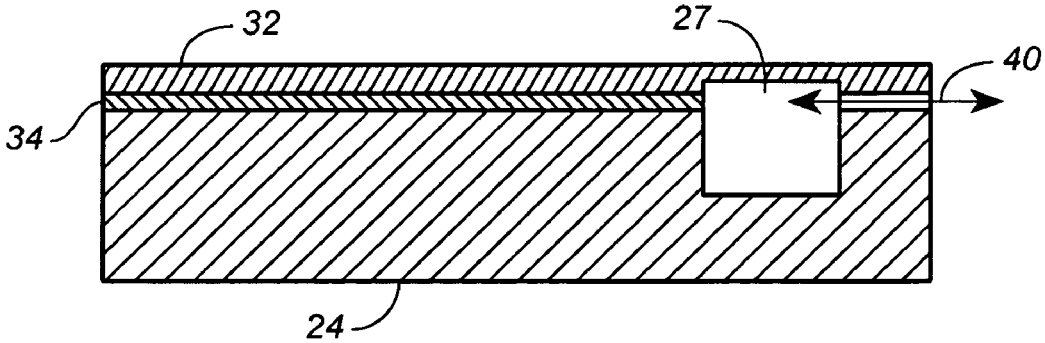
Figure 2C:
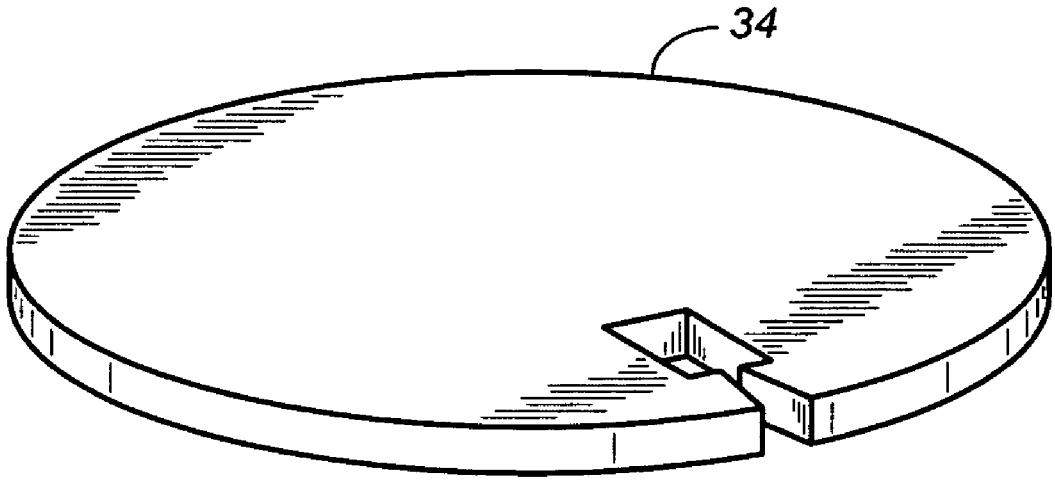
FIGS. 2C and 2D show implementations of a groove formed in a backing layer.
Figure 2D:
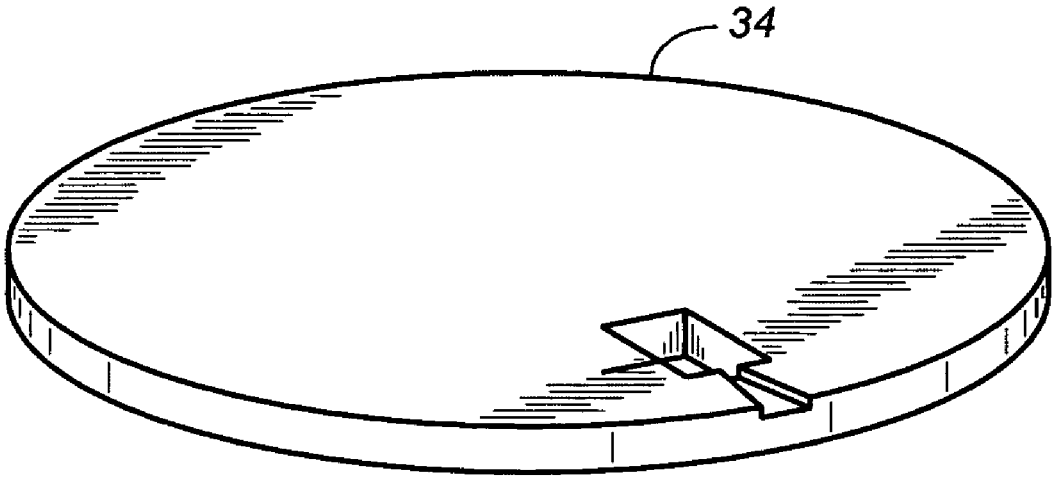

FIGS. 2A and 2B show an implementation in which a vent path 40 is formed by a groove on the underside of the polishing pad 30. For example, the groove can be formed as a radial channel in the backing layer 34. FIG. 2B shows the cross section A-A of FIG. 2A. The groove extends from the cavity 27 to the platen edge. The groove has a first end that opens to the recess and a second end that opens to an edge of the platen. The groove can be approximately 50 mils deep and 100 mils wide. Alternatively, the groove can be other than radial and, furthermore, can have dimensions other than those described. For example, the groove can be 30 mils deep. The depth of the groove can have the same depth as the thickness of the backing layer 34, which case is shown in FIG. 2C. For example, the groove can be formed by stripping the backing layer from the polishing pad. The depth of the groove can have an extent that is less than the thickness of the backing layer 34, which case is shown in FIG. 2D. The groove can be formed on the bottom surface of the backing layer, such that the vent is between the backing layer and the platen, or the groove can be formed on the top surface of the backing layer such that the vent is between the backing layer and the outer layer. Alternatively, the vent path could be provided by a passage entirely within the backing layer 34.

To prevent capillary action from suctioning in slurry from the pad edge, the groove is optionally wider at the second end, for example, by a factor of four, than it is at the first end. The groove can also be deeper at the second end than it is at the first end, or both wider and deeper at the second end than it is at the first end. For example, the groove can widen along its entire length, as shown in FIG. 2A.

For ease of exhibition, the in-situ monitoring module 50 is not shown in FIGS. 2A, 2B, 2C, and 2D. The module is also omitted from the following figures for the same reason.

Figure 3A:
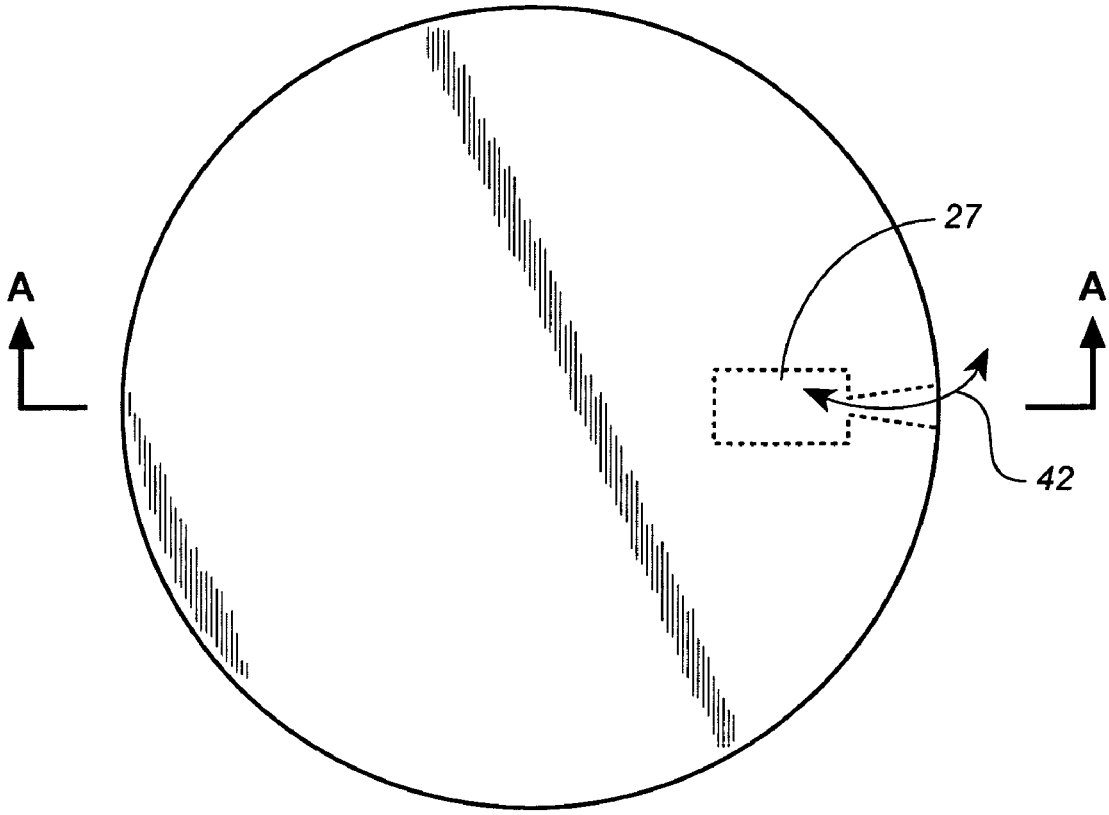
FIGS. 3A and 3B show a second implementation of a vent path.
Figure 3B:
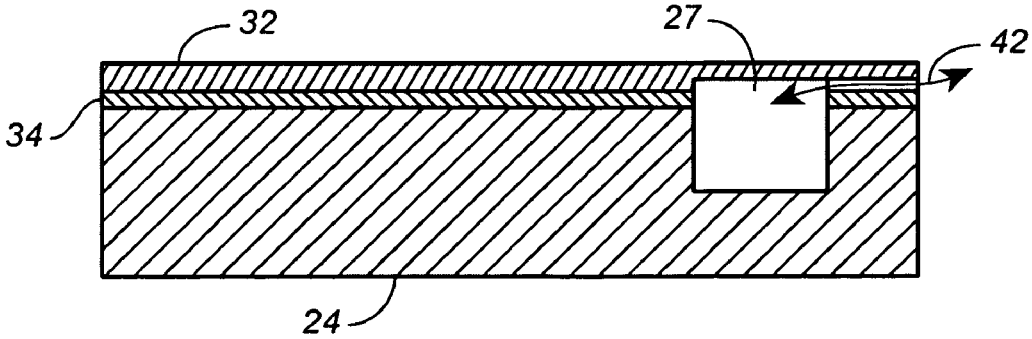

FIGS. 3A and 3B show an implementation in which a vent path 42 is formed by a radial groove on the lower surface of the outer layer 32, thus forming a passage through the polishing pad 30 between the outer layer 32 and the backing layer 34. FIG. 3B is the cross section A-A of FIG. 3A. The groove here is similar to the one formed in the backing layer 34, except that the depth of the groove is less than the thickness of the outer layer 32.

Figure 4A:
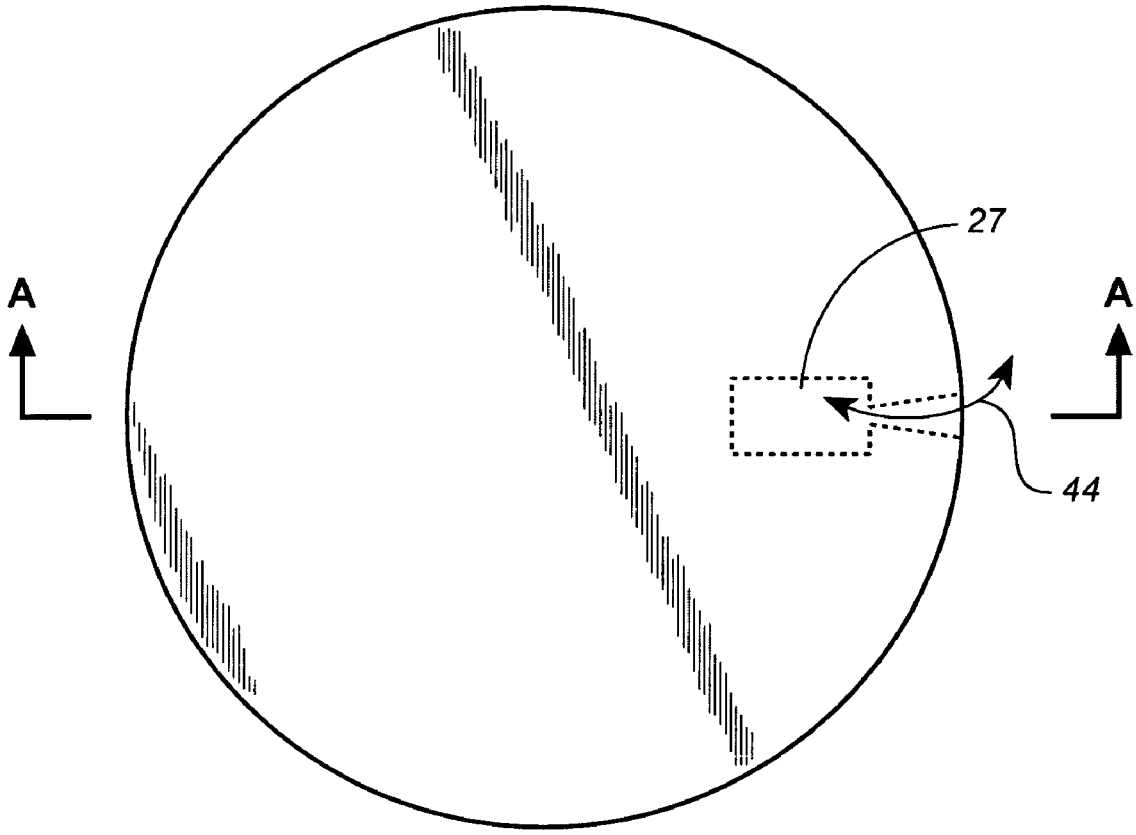
FIGS. 4A and 4B show a third implementation of a vent path.
Figure 4B:
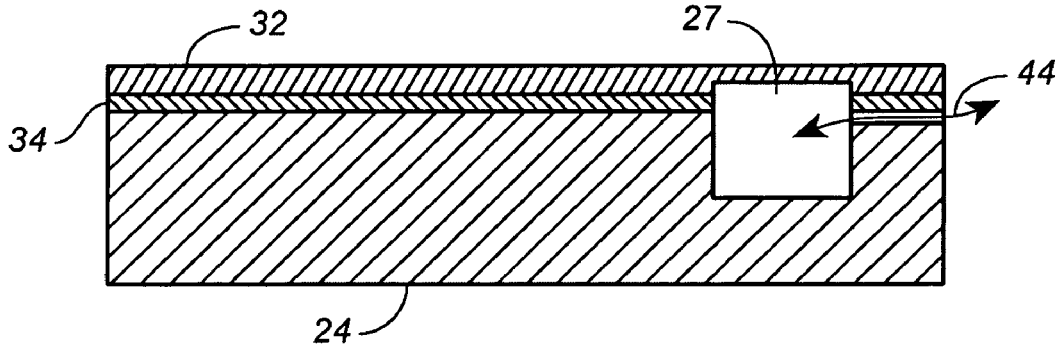

FIGS. 4A and 4B show an implementation in which a vent path 44 is formed by a radial groove on the top surface of the platen 24. FIG. 4B is the cross section A-A of FIG. 4A. The groove here is similar to the one formed in the backing layer 34.

Figure 5A:
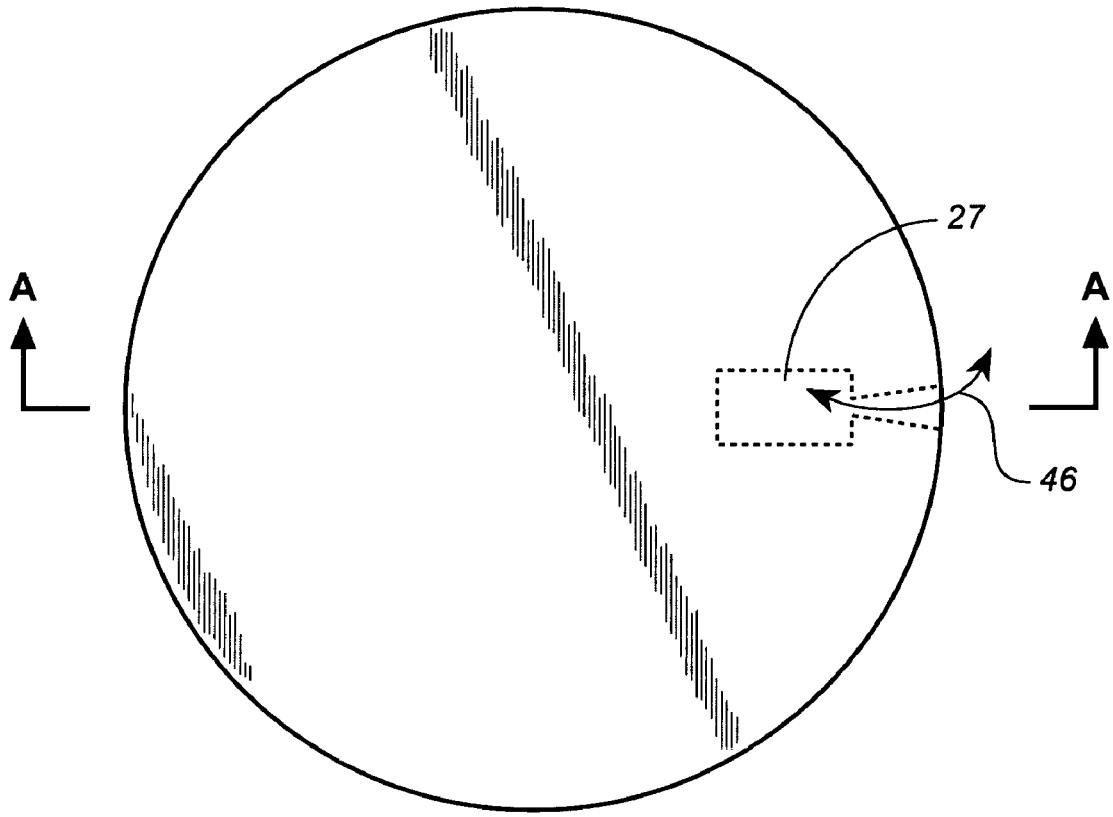
FIGS. 5A and 5B show a fourth implementation of a vent path.
Figure 5B:
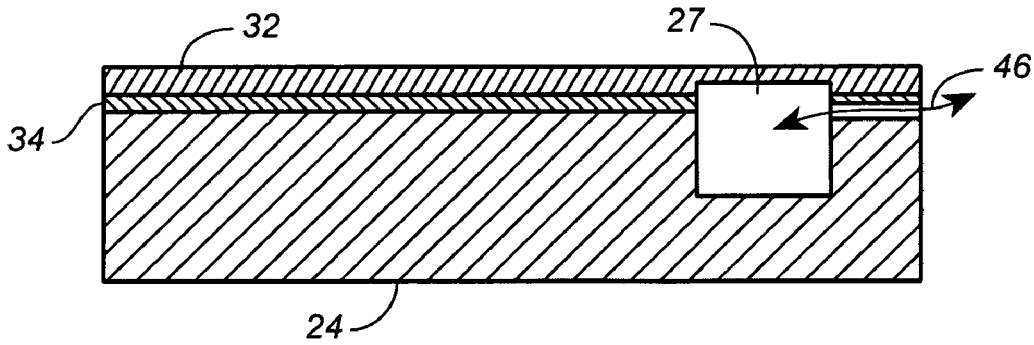

FIGS. 5A and 5B an implementation in which a vent path 46 is formed by forming radial grooves in the top surface of the platen 24 and the bottom surface of the backing layer 34. The grooves are formed so that when the backing layer 34 is mated with the top surface of the platen 24, they combine to define the vent path 46. The grooves here are similar to those described with respect to FIGS. 2A and 2B, except that they can be half as deep of the previously described grooves.

In a similar but alternative implementation (not illustrated), the grooves are formed in both the lower surface of the outer layer 32 and the upper surface of the backing layer 34. When the layers are mated, their grooves form a vent path.

Figure 6A:
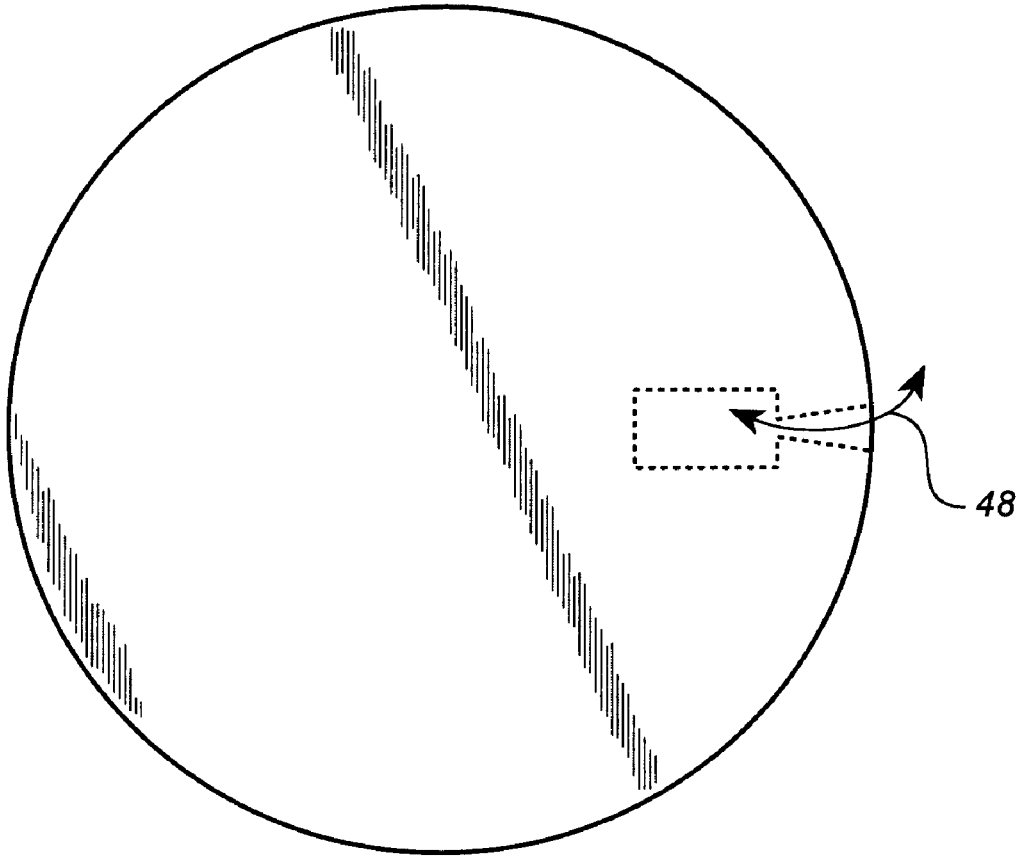
FIGS. 6A and 6B show a fifth implementation of a vent path.
Figure 6B:
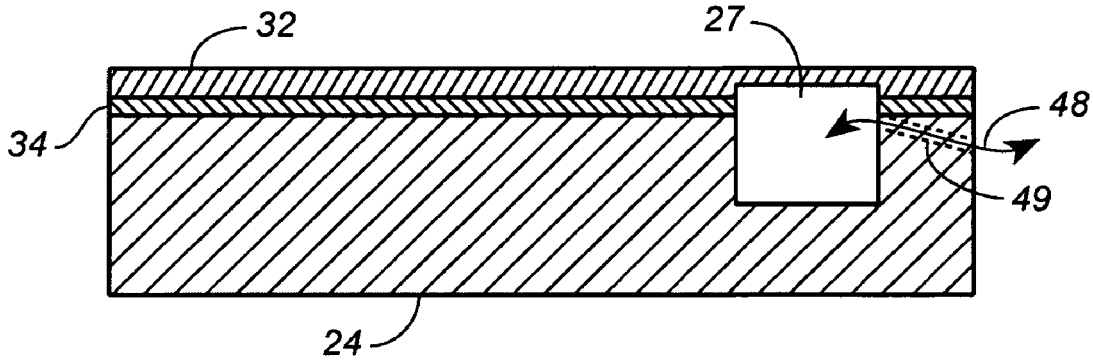

FIGS. 6A and 6B show an implementation in which a vent path 48 is formed by a passage 49 in the platen. The passage 49 has a first end that opens to the recess and a second end that opens to an edge of the platen. The first end of the passage 49 is situated at or approximately at a low point of the cavity 27, and the passage 49 slopes downward as it progresses towards the second end. The passage 49, thus, is configured to drain as well as vent trapped fluid away from the cavity 27. Alternatively, the first end of the passage 49 can be at any point in the platen 24 that is exposed to the cavity 27. Furthermore, the passage 49 need not slant downward in order to vent fluid from the cavity 27.

Figure 7:
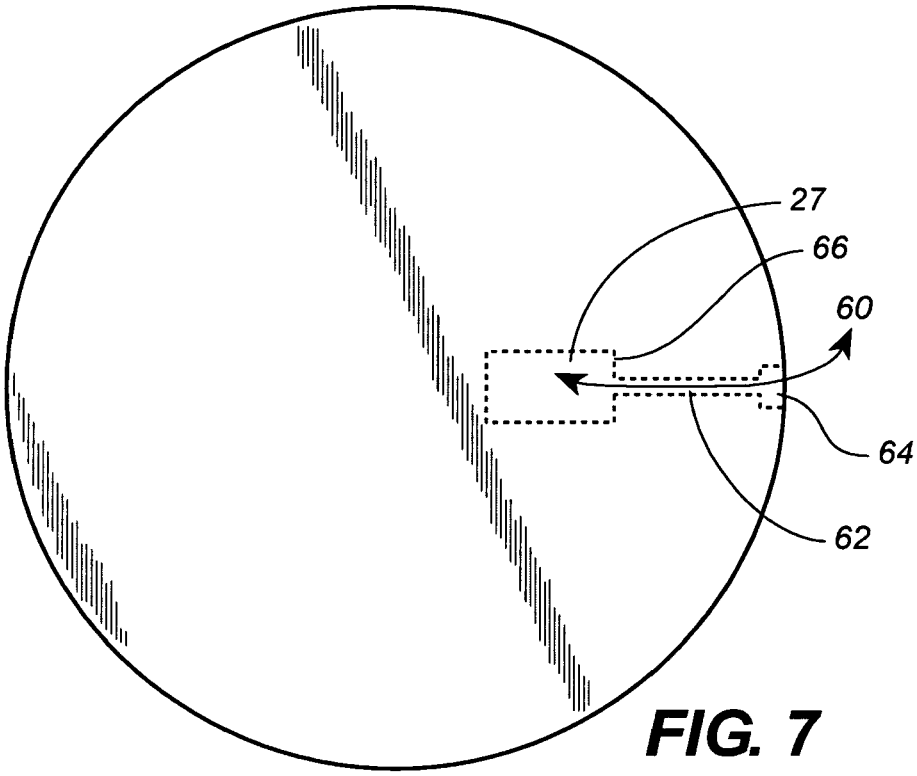
FIG. 7 shows a sixth implementation of a vent path.

FIG. 7 shows an implementation in which a vent path 60 includes a notch 66 such that the path includes a long narrow portion 62 and a widened section 64 at the pad edge to prevent capillary action from suctioning in slurry. For example, the narrow portion 62 can have a width of 0.120 inches and the widened section 64 can have a width of 0.050 inches.

Figure 8:
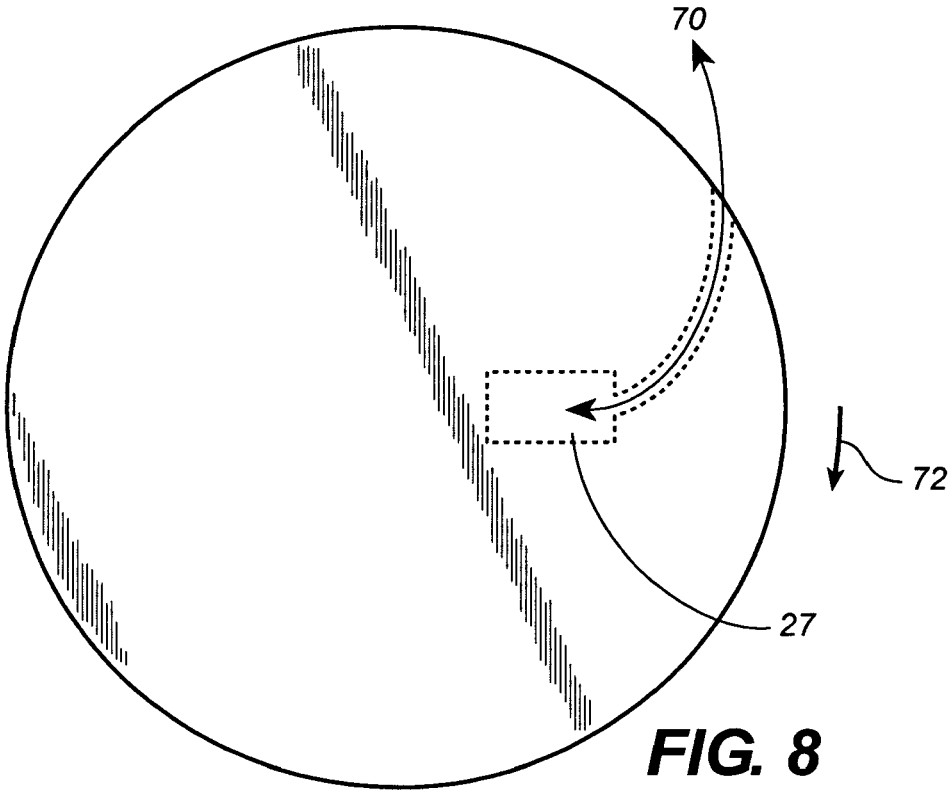
FIG. 8 shows a seventh implementation of a vent path.

FIG. 8 shows an implementation in which a vent path 70 is curved. One end of the vent path 70 opens to the cavity 27. The second end of the vent path 70 is situated at a radial offset from the first end. Preferably, during operation, the platen is rotated such that the curved vent path 70 of the polishing pad and/or platen is opposite to the direction of rotation 72 of the platen.

The above described features of vent paths, including but not limited to, varying depth or width, varying slope, and providing a curve in the vent path can optionally be implemented in vent paths in the polishing pad, vent paths in the platen, or vent paths in formed in both the polishing pad and platen.

Optionally, a second vent path can be used. For example, a passage can be formed at or approximately at the low point of the recess 26, which as shown in FIGS. 1A and 1B, can be sealed from the cavity 27 by the O-ring 52. The second passage can be similarly configured as the passage 49.

As described above, a polishing pad may have one layer or multiple layers which require assembly to form the polishing pad. In addition, the recess 27 can formed integrally in the pad, or can be part of an element that is secured to the polishing pad. The recess 27 in the polishing pad can be formed when the layer and/or element in which it resides is manufactured. Alternatively, the recess 27 can be directly machined or milled in the layer and/or element after or during assembly. Where the recess 27 is part of an element, such as a plug, that is secured to the polishing pad, the element can secured in a hole in a pad layer, and the hole can be formed during manufacture of the layer of the pad or the hole can be machined or into the layer after or during assembly of the pad.

As one example, a polishing pad layer can be formed by a molding process, such as injection or compression molding, so that the pad material cures or sets in a mold with an indentation that forms the recess. As another example, the polishing pad layer can be machined or milled to form the recess. In these two cases, the recess is formed integrally in the pad. As another example, a plug can be formed by a molding process such that the plug material cures or sets in a mold with an indentation that forms the recess. As still another example, the element can be machined to form the recess, either before or after being secured to the polishing pad.

Where the recess is formed in a backing layer of the polishing pad, the recess can be formed by removing a portion of the backing layer before or after the polishing pad has been assembled.

Where a portion of the vent path includes a groove or passage in the platen, the portion can be machined into the platen.

Where a portion of the vent path includes a groove or passage in one or more layers of the polishing pad, the portion can be formed into the layer(s) of the polishing pad when the layer is manufactured. For example, a polishing pad layer can be formed by a molding process, such as injection or compression molding, so that the pad material cures or sets in a mold with indentations that forms the grooves. Alternatively, the grooves or passages that provide the vent path can be added after the layer is manufactured. For example, grooves can be milled into a layer of the polishing pad prior to assembly of the pad. As another example, where the vent path is provided by a groove on the bottom of the backing layer of the pad, the groove can be milled into the backing layer after assembly of the pad.

The above described apparatus and methods can be applied in a variety of polishing systems. Either the polishing pad, or the carrier head, or both can move to provide relative motion between the polishing surface and the substrate. The polishing pad can be a circular (or some other shape) pad secured to the platen. Terms of vertical positioning are used, but it should be understood that the polishing surface and substrate can be held in a vertical orientation or some other orientation. The polishing pad can be a standard (for example, polyurethane with or without fillers) rough pad, a soft pad, or a fixed-abrasive pad.

Although described as being positioned in the same module, the optical and eddy current monitoring systems can be included in different modules that are placed at different locations on the platen. For example, the optical monitoring system and eddy current monitoring system can be positioned on opposite sides of the platen, so that they alternately scan the substrate surface. Moreover, the invention is also applicable if no optical monitoring system is used and the polishing pad is entirely opaque. In these two cases, the recesses or apertures to hold the core are formed in one of the polishing layers, for example, the outermost polishing layer of the two-layer polishing pad, as described above.

Although the polishing pad described above includes multiple layers, the inventive features described above can be implemented in a single layered polishing pad. In such an implementation, the grooves in the polishing pad can be formed on the bottom surface of the pad and, furthermore, are not as deep as the pad is thick.

The eddy current monitoring system can include separate drive and sense coils, or a single combined drive and sense coil. In a single coil system, both the oscillator and the sense capacitor (and other sensor circuitry) are connected to the same coil.

A number of embodiments of the invention have been described. Nevertheless, it will be understood that various modifications may be made without departing from the spirit and scope of the invention. Accordingly, other embodiments are within the scope of the specification.

What is claimed is:

1. A polishing system, comprising:

a polishing pad that includes a polishing surface, a non-polishing surface, and a first recess in the non-polishing surface, the first recess having a depth less than the thickness of the polishing pad, wherein the first recess has no opening to the polishing surface;

a platen that supports the polishing pad at a surface that is configured to receive the polishing pad and that includes a second recess; the second recess being configured to receive an in situ monitoring module;

a cavity formed at least in part by the first recess and one of:

i) an upper surface of the monitoring module; or ii) the platen; and a vent path, the vent path having a first opening to the cavity and a second opening not to the cavity and not to the polishing surface.

2. The polishing system of claim 1 wherein:

the platen further comprises a side edge;

and the second opening is to the side edge.

3. The polishing system of claim 2, wherein:

the vent path includes a passage formed in the platen.

4. The polishing system of claim 1, wherein:

the vent path is curved and the second opening is located at an angular offset from the first opening.

5. The polishing system of claim 1, wherein:

the vent path slopes so as to drain fluid from the cavity.

6. The polishing system of claim 1, wherein:

the vent path has a depth which varies along the length of the vent path.

7. The polishing system of claim 1, wherein:

the second opening is wider than the first opening.

8. The polishing system of claim 7, wherein:

the vent path is notched to form the wider second opening.

9. The polishing system of claim 7, wherein:

a width of the vent path gradually increases to form the wider second opening.

10. The polishing system of claim 1, wherein:

the vent path is formed partly in the polishing pad and partly in the platen.

11. The polishing system of claim 10, wherein:

the vent path includes a first groove formed on the surface of the platen and a second groove on the non-polishing surface of the polishing pad.

12. The polishing system of claim 1, wherein:

the vent path includes a groove formed on the surface of the platen.

13. The polishing system of claim 1, wherein:

the vent path is formed in the polishing pad.

14. The polishing system of claim 13, wherein:

the polishing pad further comprises a side edge surface; and the second opening is to the side edge surface.

15. The polishing system of claim 13, wherein:

the polishing pad includes an outer layer and a backing layer.

16. The polishing system of claim 15, wherein:

the vent path includes a groove formed in the backing layer.

17. The polishing system of claim 16, wherein:

the groove has the same thickness as the backing layer.

18. The polishing system of claim 13, wherein:

the vent path includes a groove formed on the non-polishing surface.

19. The polishing system of claim 1, wherein:

a portion of the polishing pad above the first recess is opaque.

20. The polishing system of claim 1, wherein:

a portion of the polishing pad above the first recess is transparent.

* * * * *